US006824505B1

(12) United States Patent
Chang

(10) Patent No.: US 6,824,505 B1
(45) Date of Patent: Nov. 30, 2004

(54) BUFFER OF A DAMPING MECHANISM OF AN EXERCISE MACHINE

(76) Inventor: Fu-Chen Chang, No. 10, Lane 256, Sec.1, Ya Huan Rd., Ta Ya Hsiang, Taichung Hsien (TW)

( * ) Notice: Subject to any disclaimer, the term of this patent is extended or adjusted under 35 U.S.C. 154(b) by 0 days.

(21) Appl. No.: 10/425,044

(22) Filed: Apr. 29, 2003

(51) Int. Cl.[7] ..... A63B 21/068

(52) U.S. Cl. ..... 482/95; 482/92; 482/93; 482/94; 482/96; 482/97; 482/98; 482/99; 482/100; 482/101; 482/102; 482/148; 482/120; 482/135; 482/136; 482/137

(58) Field of Search ..... 482/92–102, 135–137, 482/148

(56) References Cited

U.S. PATENT DOCUMENTS 5,290,214 A * 3/1994 Chen ..... 482/137
5,336,153 A * 8/1994 Chen ..... 482/137
RE37,648 E * 4/2002 Fulks ..... 482/100
6,471,624 B1 * 10/2002 Voris ..... 482/142
6,579,213 B1 * 6/2003 Webber et al. ..... 482/100
6,682,466 B1 * 1/2004 Ellis ..... 482/142
6,719,672 B1 * 4/2004 Ellis et al. ..... 482/99

* cited by examiner

*Primary Examiner*—Nicholas D. Lucchesi
*Assistant Examiner*—Lori Amerson
(74) *Attorney, Agent, or Firm*—Harrison & Egbert

(57) ABSTRACT

An exercise machine includes at least one body-building structure, and at least one damping structure serving to bring about a damping effect. The body-building structure is provided with an actuating pulley serving to actuate one or more weighted pulleys of the damping structure in conjunction with a cable. The actuating pulley adds a buffer to the damping effect, thereby preventing a sharp impact from inflicting an injury on a body part of an exerciser.

1 Claim, 5 Drawing Sheets

BUFFER OF A DAMPING MECHANISM OF AN EXERCISE MACHINE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a damping mechanism of the exercise machine, and more particularly to the damping mechanism which is provided with means to add a buffer to the damping mechanism, so as to prevent sharp impact between antagonistic forces.

BACKGROUND OF THE INVENTION

The conventional exercise machine comprises a damping mechanism which is used to provide a damping force to act in opposition to the force exerting on the machine by an exerciser, thereby resulting in a body-building effect. The damping mechanism of the conventional exercise machine is defective in design in that it is not provided with means to prevent sharp impact capable of inflicting bodily injuries on a user of the machine.

BRIEF SUMMARY OF THE INVENTION

It is therefore the primary objective of the present invention to provide an exercise machine with means to add a buffer to a damping mechanism of the exercise machine, thereby making the exercise machine relatively safe to use.

In keeping with the principle of the present invention, the foregoing objective of the present invention is attained by an exercise machine comprising a body-building structure and a damping mechanism. The body-building structure is used to accommodate the body parts of an exerciser, while the damping mechanism is used to provide a damping force acting in opposition to the force which is exerted on the body-building structure by the exerciser. The damping mechanism comprises an actuating pulley, and a series of weighted pulleys which are actuated to turn by the actuating pulley. The actuating pulley is in turn driven by the body-building structure, thereby serving as a buffer.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
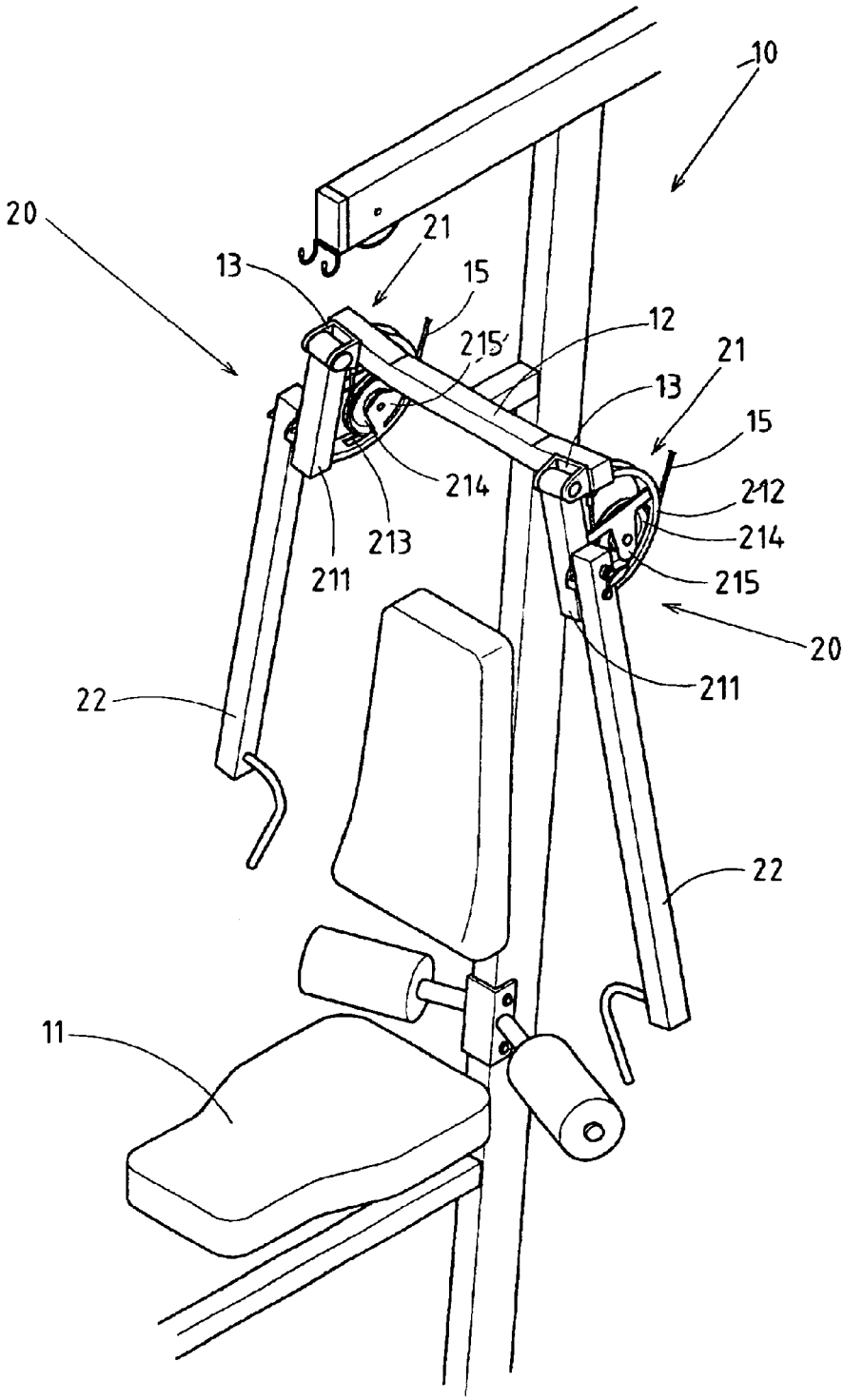
FIG. 1 shows a perspective view of the preferred embodiment of the present invention.
Figure 2:
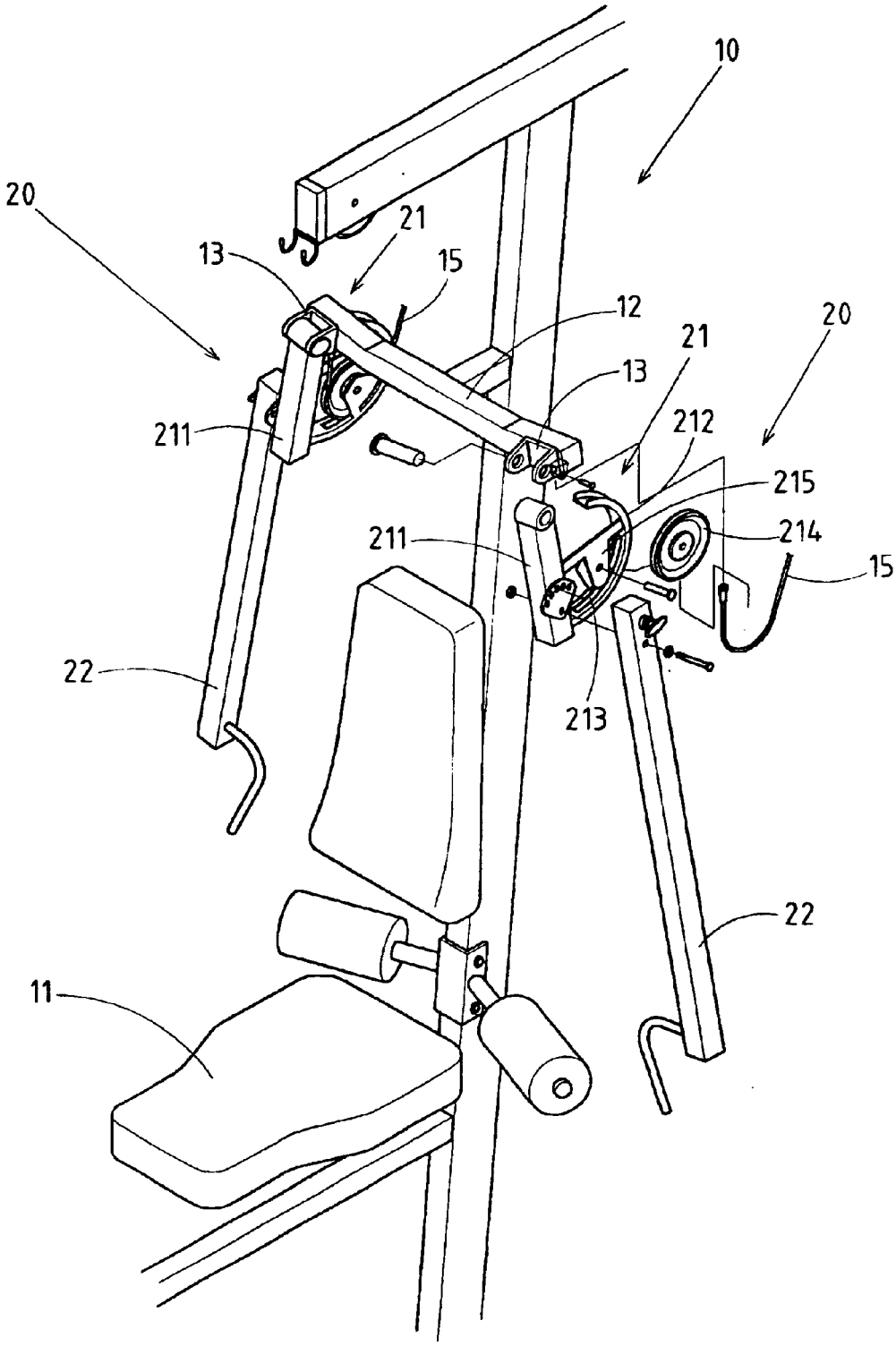
FIG. 2 shows an exploded perspective view of an arm-building frame of the preferred embodiment of the present invention.
Figure 3:
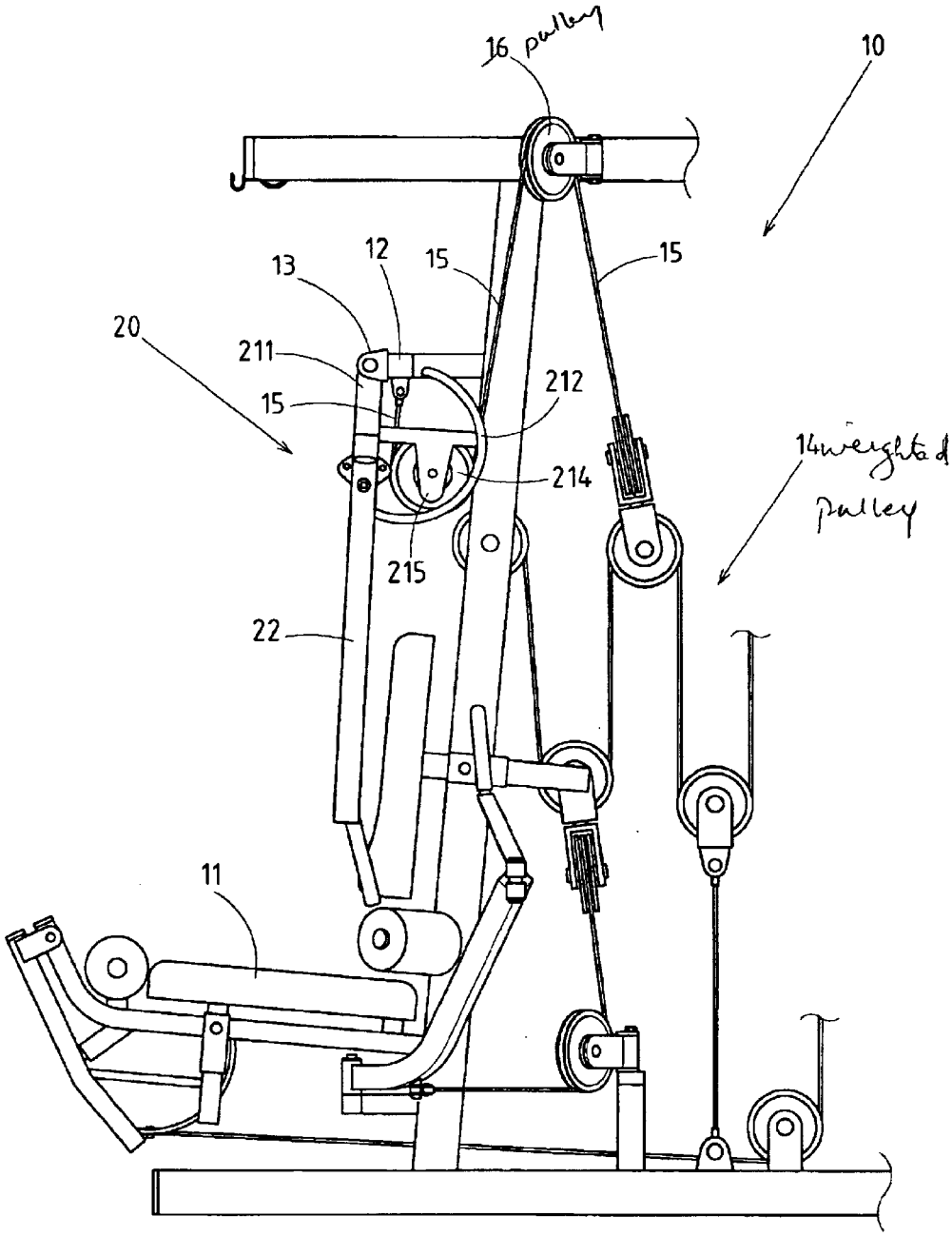
FIG. 3 shows a side schematic view of the preferred embodiment of the present invention.
Figure 4:
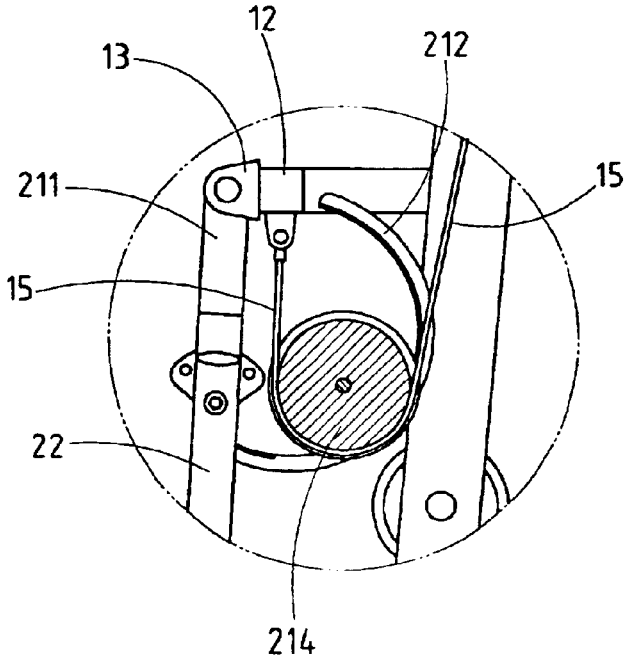
FIG. 4 shows a sectional schematic view of the arm-building frame of the preferred embodiment of the present invention.

As shown in FIGS. 1–4, an arm-building machine 10 embodied in the present invention comprises a seat 11, a support frame 12, a damping mechanism, and two arm-building structures 20.

The two arm-building structures 20 are identical in construction to each other and are mounted at two opposite ends of the support frame 12. Each arm-building structure 20 comprises a pivoting member 21 and a push bar 22 capable of being pushed up and down with the hand of an exerciser. The pivoting member 21 is formed of a pivoting rod 211, a pivoting plate 212, and an actuating pulley 214. The pivoting member 21 is fastened with the support frame 12 and the push bar 22 in such a way that one end of the pivoting rod 211 is pivoted to a lug 13 of the support frame 12, and that other end of the pivoting rod 211 is fastened with the push bar 22. The pivoting plate 212 has an arcuate through hole 213 and a pivoting portion 215. The actuating pulley 214 is pivotally fastened with the pivoting portion 215 such that the actuating pulley 214 is received in the arcuate through hole 213 of the pivoting plate 212.

The damping mechanism comprises a series of weighted pulleys 14, and a cable 15 which is fastened at one end to the support frame 12 via an intermediate pulley 16 such that one end of the cable 15 runs through the actuating pulley 214, with the other end of the cable 15 running through the weighted pulleys 14.

Figure 5:
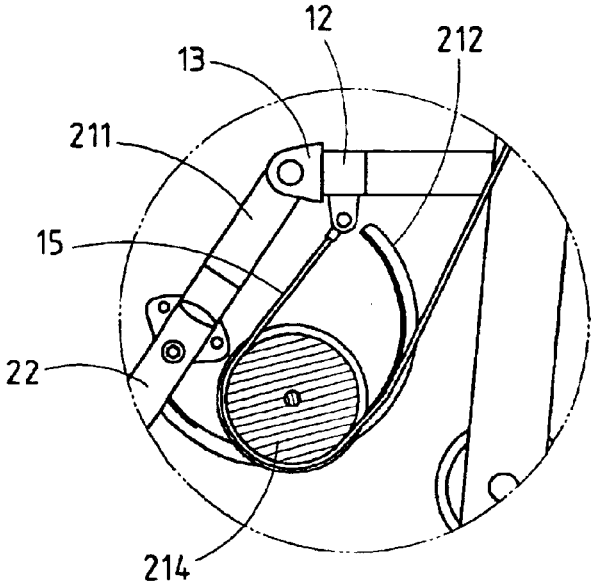
FIG. 5 shows a sectional schematic view of the arm-building frame of the preferred embodiment of the present invention in action.
Figure 6:
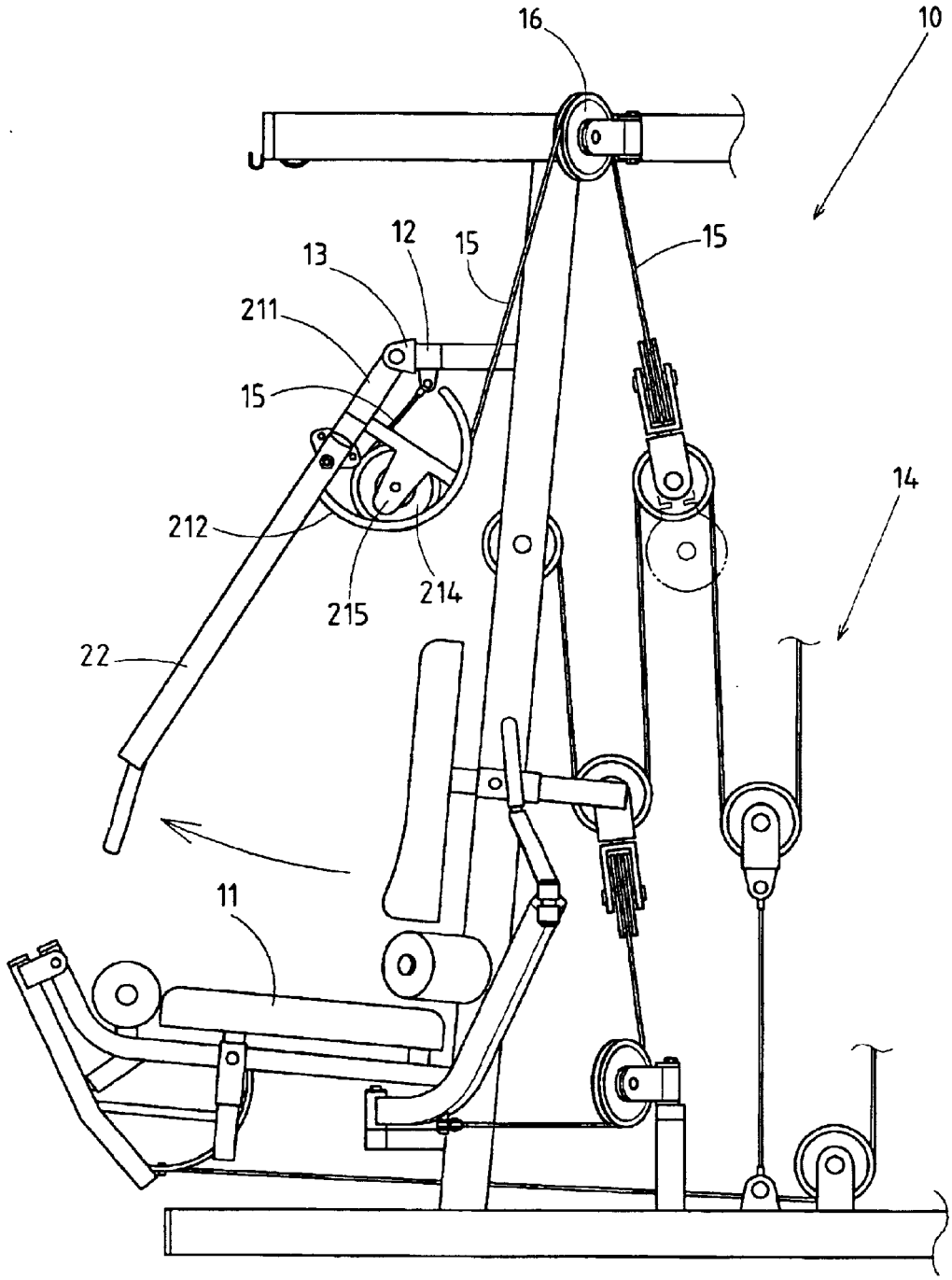
FIG. 6 shows a side schematic view of the preferred embodiment of the present invention in action.

As illustrated in FIGS. 5 and 6, when the push bar 22 is lifted with the hand of an exerciser, the pivoting rod 211 of the pivoting member 21 is lifted along with the push bar 22. As a result, the actuating pulley 214 is caused to displace so as to pull the cable 15 to bring about a damping effect. In another words, the actuating pulley 214 serves to add a buffer to the damping mechanism, thereby preventing a sharp impact-from inflicting an injury on the hand of the exerciser.

The preferred embodiment of the present invention described above is to be regarded in all respects as being nonrestrictive. Accordingly, the present invention may be embodied in other specific forms without deviating from the spirit thereof. The present invention is therefore to be limited only by the scope of the following claim.

I claim:

1. An exercise machine comprising:

a support frame;

at least one body-building structure connected to said support frame, the body-building structure comprising:

a pivoting member pivotally connected to said support frame, said pivoting member having a curved plate with an arcuate through hole formed therein, said pivoting member having an actuating pulley rotatably received within said curved plate; and a body-building member suitable for accommodating a body part of a person using the exercise machine, said body-building member fastened to one end of said pivoting member; and at least one damping structure having at least one or more weighted pulleys and a cable, said cable being fastened at one end to said support frame, said cable having another portion extending around the weighted pulley, said cable having another portion extending around said actuating pulley and extending through said arcuate through hole, said actuating pulley being displaceable so as to pull said cable when said body-building member is displaced by an external force.

* * * * *